US005372561A

United States Patent [19]

Lynch

[11] Patent Number: 5,372,561

[45] Date of Patent: Dec. 13, 1994

[54] APPARATUS FOR SUSPENSION ASSISTED AMBULATION

[75] Inventor: Robert P. Lynch, Tulsa, Okla.

[73] Assignee: Lyntech Corp., Tulsa, Okla.

[21] Appl. No.: 196,415

[22] Filed: Feb. 15, 1994

[51] Int. Cl.[5] ..... A63B 23/06

[52] U.S. Cl. ..... 482/54; 482/74

[58] Field of Search ..... 482/54, 69, 71, 74, 482/55; 119/700, 712

[56] References Cited

U.S. PATENT DOCUMENTS

| | | | |
|---|---|---|---|
| 4,861,021 | 8/1989 | Edwards et al. | 482/69 |
| 4,907,571 | 3/1990 | Futaliami | 482/69 X |
| 4,986,261 | 2/1991 | Iams et al. . | |
| 5,100,127 | 3/1992 | Melnick et al. | 119/700 |

OTHER PUBLICATIONS

Incremental Weightbearing System, SOMA Inc. Advertisement Attached.

*Primary Examiner*—Stephen R. Crow
*Assistant Examiner*—Glenn E. Richman

[57] ABSTRACT

An exercising device combining a treadmill with an upper-body suspension device is disclosed. An upright frame is supported from the base of the treadmill. A gantry frame is pivotally attached to the upper end of such upright frame. Pneumatic linear actuators are interconnected between upright and gantry frames to provide rotation of said gantry in relation to said upright frame. An upper-body harness is suspended from the gantry frame. Introduction of regulated air pressure into the pneumatic actuators exerts an upward force on the harness and facilitates walking exercise with less than the full gravitational force on the subjects lower extremities.

4 Claims, 5 Drawing Sheets

APPARATUS FOR SUSPENSION ASSISTED AMBULATION

BACKGROUND OF THE INVENTION

1. Field of the Invention

This invention relates to the field of exercising and physical therapy devices.

2. Description of the Related Art

U.S. Pat. No. 4,986,261, "Apparatus for Performing Coordinated Walking Motions With the Spine in an Unloaded State" issued to Iams and Splane Jr. is cited as related art. This invention places the subject in a prone position so as to remove the weight of the upper-body from the spine while the apparatus enables the movement of the legs in a manner akin to walking.

In as much as my invention allows the subject to be positioned in the normal vertical attitude, it can be appreciated that it has no functional relation to the invention of Messrs: Iams and Splane Jr.

BACKGROUND

The present invention relates to an apparatus suitable for use in therapy of individuals suffering from diminished ambulatory capability and balance problems.

In such cases where a physical or neurological impairment prevents normal ambulation of an individual and requires assistance of either mechanical devices or other persons to stabilize, support or balance, the effected person becomes dependent upon such means for normal walking movement rendering such individuals as disabled.

Additionally, neurological disorders such as stroke can cause a person to have diminished ambulatory control capability on one or both sides of the body and thus the walking process must be re learned.

Persons with constructive surgery to the hip, knee, ankle, etc., in many cases, have to re-introduce the impaired joint to walking at less than full weight on said joint. This is often accomplished by assistants holding the person up and lifting on the person's arms to lessen the person's weight on the impaired joint which is a procedure controlled by human estimation and is not scientific.

A device that assists non-ambulatory persons with walking. is similar to an infant's walker in that they have a strap suspension arrangement and forearm rests to allow the person to place some weight on the forearms and to push with the feet to move the device. This device has the disadvantage of requiring the person to have sufficient upper body strength to support the weight. This device has a further disadvantage in that the pushing force of the feet employs muscle combinations that are not normal walking patterns.

A device that assists non-ambulatory persons with walking exercise is comprised of a bridge frame with a constant tension winch with the winch wire fairleaded to a pulley at the center of the cross-member so as to support a person in an upper-body harness. This device can be placed astraddle a conventional treadmill and thus facilitate walking exercise at altered weight conditions. This device has an inherent disadvantage in that the person is suspended by a single wire and is free to rotate and swing which can be hazardous. The device, not having a treadmill being an integral part of the apparatus, has the disadvantage of potential stability problems. Furthermore, constructing both a bridge crane and treadmill requires duplication of some members and functions which result in an increased cost of manufacture in comparison to my invention described hereunder.

An arrangement of devices that has been configured to facilitate suspension assisted ambulation is to employ a walking treadmill with a counterbalance weight system. The counterbalance system consists of a cable and pulley arrangement which interconnects an upper-body harness on one end and a selective weight arrangement commonly referred to as a "weight stack" on the other end. The upper-body harness is used to suspend the patient. The cable pulleys are arranged so as to be able to suspend the patient over the treadmill with one pulley located over the treadmill and the other over the weight stack. By adding weight, a percentage of the patient's weight is counterbalanced. As the patient walks, the weights are free to oscillate in the vertical direction so as to accommodate the vertical movement of the body that occurs during ambulation. A problem occurs with this arrangement due to the mass and thus inertia of the suspended counterbalance weight. As the patient walks at moderate speeds, the vertical movement of the body causes the suspended weight mass to oscillate in the vertical direction synchronous with the cadence of the walking movement. However, as the speed of the walking increases, the inertia of the weights changing direction in their vertical excursion results in the weight movement becoming non-synchronous with the walking cadence. This results in impact surges at the harness and thus surges applied to the patient. This, of course, defeats the purpose of the exercise because at times the patient can be subjected to less than the desired counterbalance force and at other times, subjected to jarring uplift forces greater than the selected weight. The surge impacts are also uncomfortable and disconcerting to the patient.

It can be appreciated that an apparatus that can suspend a controlled portion of a person's weight and allow near normal walking without imparting significant surge departures from the desired weight unloading force, would be a beneficial means of providing ambulation training and exercise. The invention described hereunder provides these features and benefits.

SUMMARY OF THE INVENTION

It is an object of this invention to provide a vertically moveable gantry frame in conjunction with a treadmill with attachment points on said gantry frame which allow attachment of an upper-body harness so as to suspend a person so that said person can ambulate with less than gravitational weight on the lower extremities.

It is a further object of this invention to provide a variable computerized control and monitoring system to operate and control the system.

In a broad sense, this invention is an exercising device which includes a treadmill and an upper-body suspension means supported by a frame attached to the base of said treadmill. By using this device, I can provide ambulatory exercise to individuals who are unable to walk with their full gravitational weight on their lower extremities due to neurological impairments, injury, or constructive surgery.

The exercising device comprises a treadmill, a vertical support frame affixed to such treadmill, a gantry frame pivotally attached to said vertical support frame, and an upper-body harness suspended from solid gantry frame.

Pneumatic linear actuators are pivotally connected to the vertical support frame and the gantry frame. Regulated air pressure may be introduced into the pneumatic linear actuators to effect a rotational movement to the gantry frame in relation to the support frame and thus exert an upward force on the upper-body harness. The magnitude of the vertical force exerted on the upper-body harness is a function of the regulated air pressure.

By regulating the air pressure I can vary the uplift force applied to meet the requirements of each subject so that individuals who only need to be stabilized can ambulate with near full weight on their feet and where individuals who cannot tolerate full weight on a lower extremity joint may have the joint load reduced by a substantial percentage of their body weight.

The use of air pressure to actuate the upper-body suspension system allows it to instantly adjust to the vertical translational excursion of the body that occurs during ambulation and thus preclude oscillating shocks being induced to the user.

The control of the various parameters of the machine, (belt speed, uplift force, time) are preferably controlled, monitored and recorded by a computer.

The objectives are meant to be illustrative and not limiting. The manner of operation, novel features and further objectives and advantages of this invention may be better understood by reference to the following description and drawings.

DETAILED DESCRIPTION OF THE PREFERRED EMBODIMENT

Figure 1:
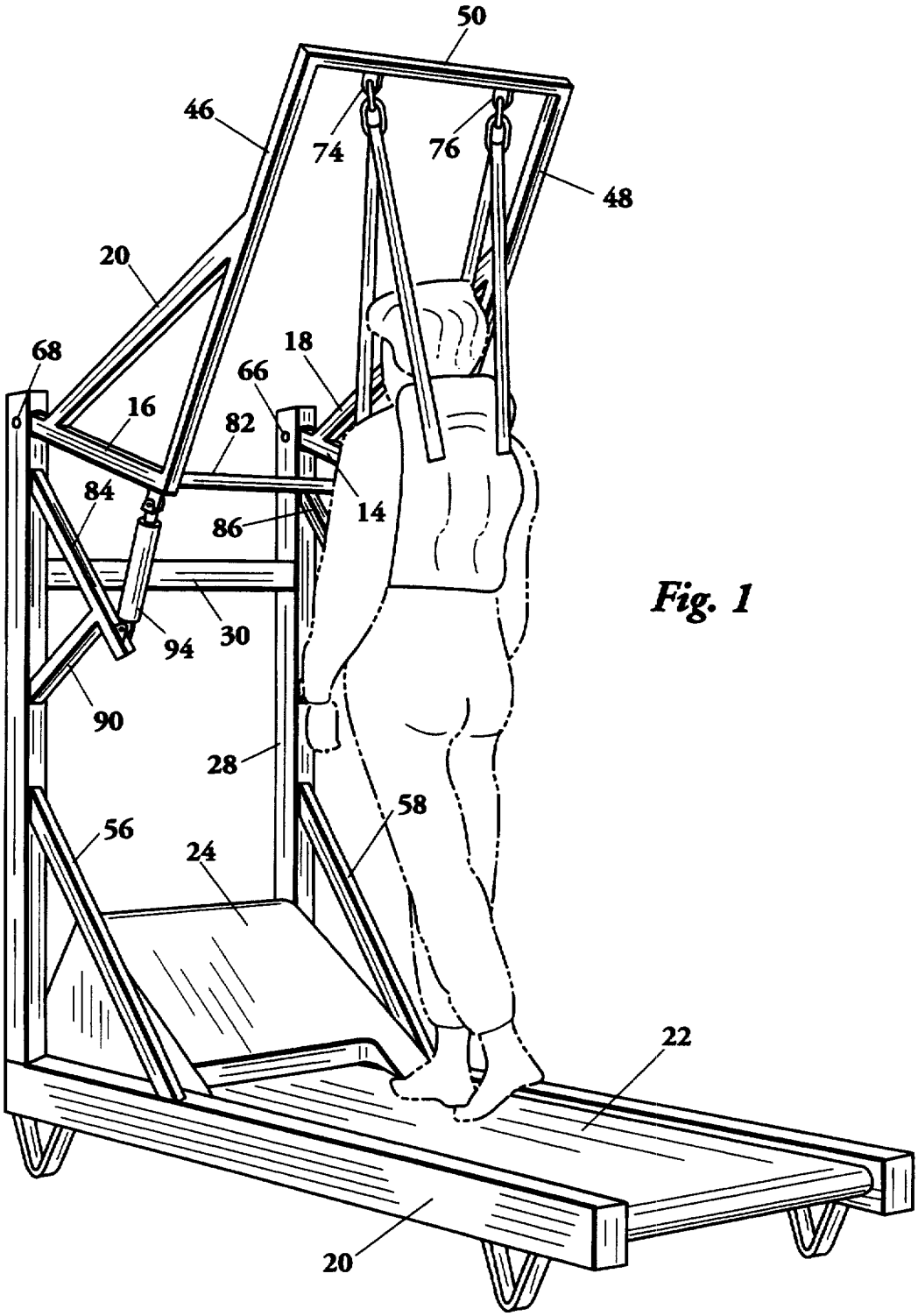
FIG. 1 is a prospective view of the exercise device.
Figure 3:
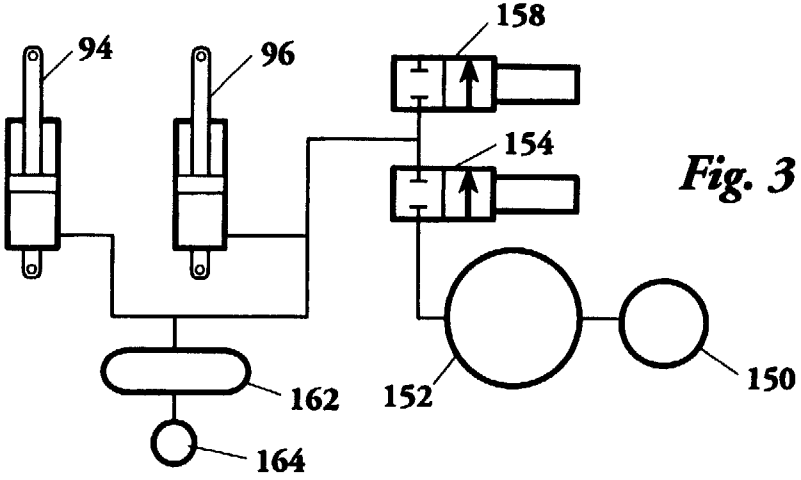
FIG. 3 is a schematic view of the pneumatic system used to control pressure in the gantry actuation means.

FIG. 1 illustrates the exercise machine in perspective view. As seen in FIG. 3, the apparatus includes a base frame 20 which holds an endless treadmill belt 22. At the forward end of the base frame 20 a housing 24 covers the motor or motive means to drive the treadmill belt 22. An upright support frame extends upward from the forward end of the base frame 20. In this embodiment, there is a left upright support frame member 26 and a right upright support frame member 28. Between these two upright support frames 26 and 28 there are one or more support frame cross-members 30.

Still referring to FIG. 1, there are two lower brace members, a left lower brace 56 and a right lower brace 58. These braces 56 and 58 are fastened at their upper ends to the upright support frames 26 and 28 and at their lower ends to the base frame 20.

Still referring to FIG. 1, the gantry frame will now be described. Configuration of the gantry in the preferred embodiment shall have a pair of extending pivot arms pivotally connected to the upright frame with left extending arm 16 pivotally fastened at pivot point 68 and right extending pivot arm 14 pivotally fastened at pivot point 66 by suitable means. Left upwardly extending member 46 is fastened to left extending pivot arm 16 and right upwardly extending member 48 is fastened to right extending pivot arm 14. Upper cross-member 50 is attached to the upward extremities of left upwardly extending member 46 and right upwardly extending member 48. Left diagonal brace 20 is attached at its lower end to left extending pivot arm 16 and left upwardly extending member 46 at its upper end. Right diagonal brace 18 is attached at its lower end to right extending pivot arm 14 and right upwardly extending member 48 at its upper end. Lower cross-member 82 is connected to left extending pivot arm 16 and right extending pivot arm 14 near their rearward extremities. Left pad-eye 74 and right pad-eye 76 are attached to upper cross-member 50 to provide attachment points for an upper-body harness.

Still referring to FIG. 1, below the gantry frame, there are two braces which serve as supports for pneumatic linear actuators. Left brace 84 is connected at its upper end to left upright support frame 26 and right brace 86 is connected at its upper end to right upright support frame 28. The lower portion of both braces 84 and 86 are supported by struts, a left strut 90 and a right strut 92. These struts 90 and 92 are attached to the upright support frames 26 and 28 at one end and to the braces 84 and 86 at their other end.

Still referring to FIG. 1, left pneumatic linear actuator 94 is pivotally fastened between left brace 84 and left gantry extending pivot arm 16, and right pneumatic linear actuator 96 ( not shown this view) is pivotally fastened between right brace 92 and right gantry extending pivot arm 14 and provide movement means of said gantry frame about pivot points 66 and 68.

Figure 2:
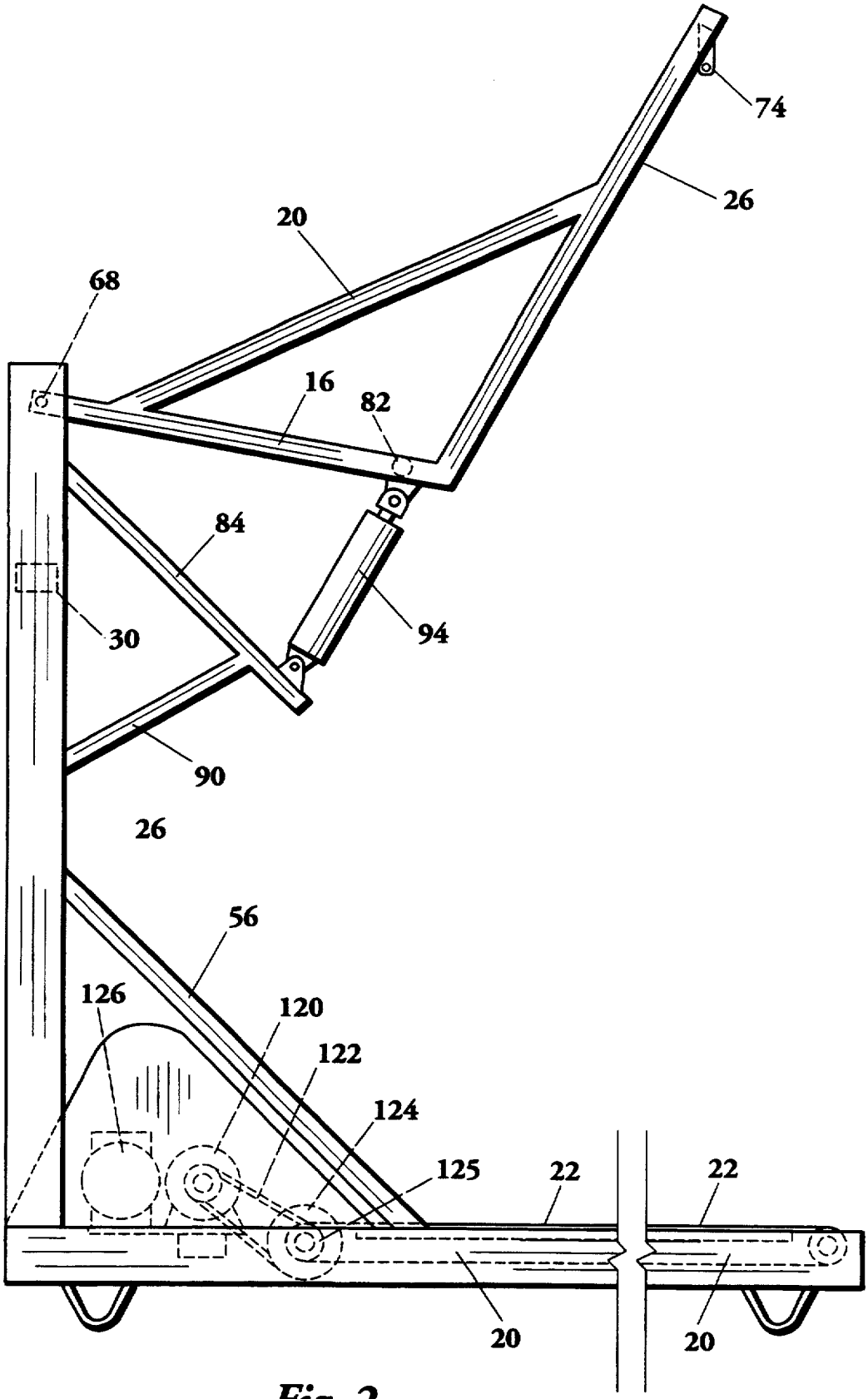
FIG. 2 is a side elevation view of the exercise device.

FIG. 2 illustrates the device in a side elevation and in addition to the structure, also shows some of the internal components within the housing 24 at the forward end of the base frame 20. This includes a motor 120 with a drive belt 122 and pulley 124 that can turn a spindle 125 which causes the endless belt 22 to move. There is also an air compressor 126 to supply pressurized air for the pneumatic system.

FIG. 3 illustrates, in schematic form, the operating and control system for the pneumatic linear actuators 94 and 96. This includes a motor 150 and an air compressor 152 with a solenoid valve 154 that controls air flow into the pneumatic linear actuators 94 and 96 and solenoid valve 158 that vents air pressure. Connected to the air supply line is an air receiver 162 and a pressure transducer 164. The pressure transducer 164 is capable of providing a signal indicative of the pressure in the air receiver 162.

As can be seen from the foregoing description, there are a number of independently variable parameters that can be changed when using this device;

1. Speed of the treadmill belt.
2. Suspension force.
3. Length of use time.
4. Variable time/suspension force protocols
5. Suspension force as a percentage of body weight.

Figure 4A:
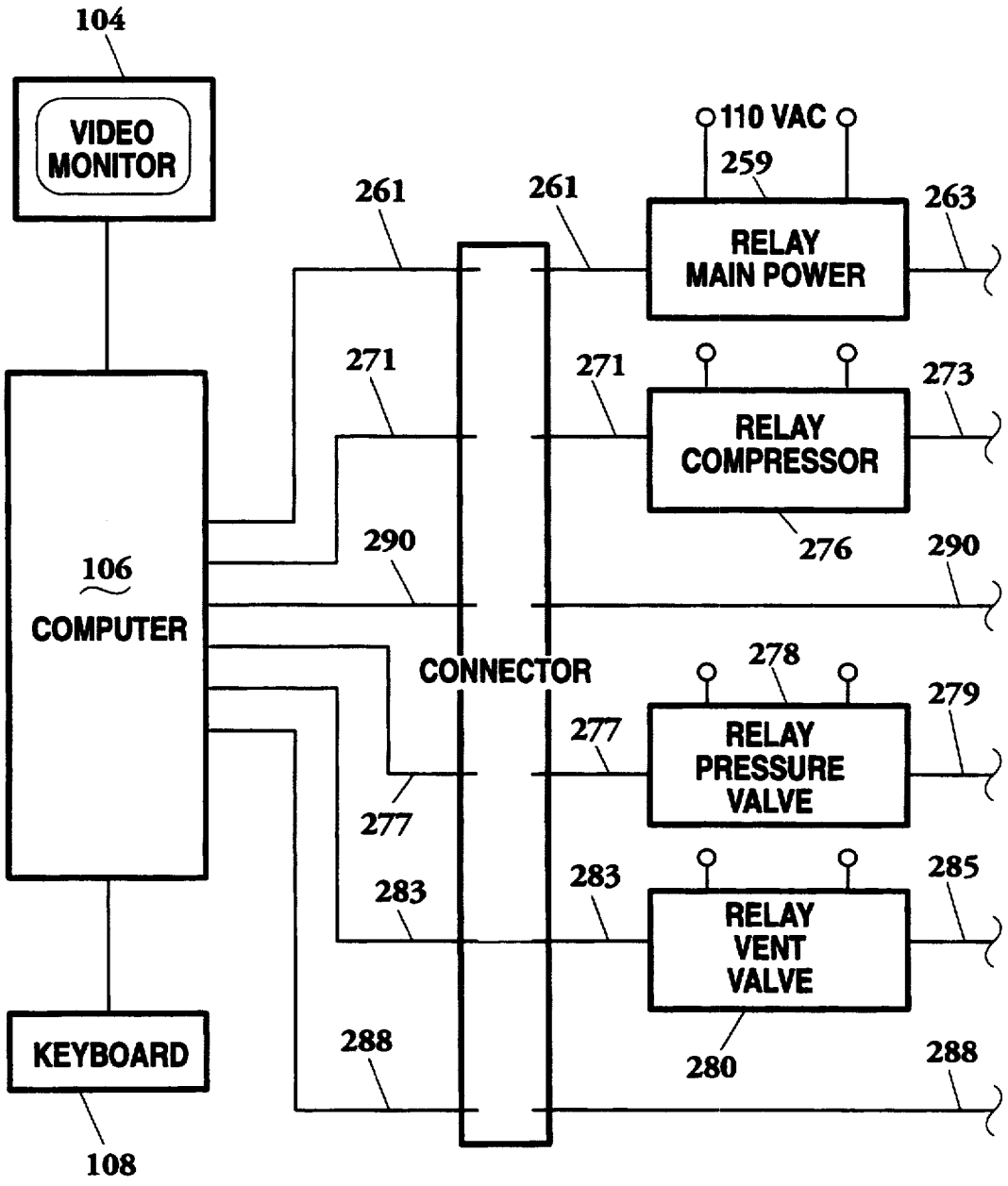
FIG. 4A is a schematic view of the computer control system and pneumatic and motor drive system of the device, and is part of a larger Figure completed in FIG. 4B.
Figure 4B:
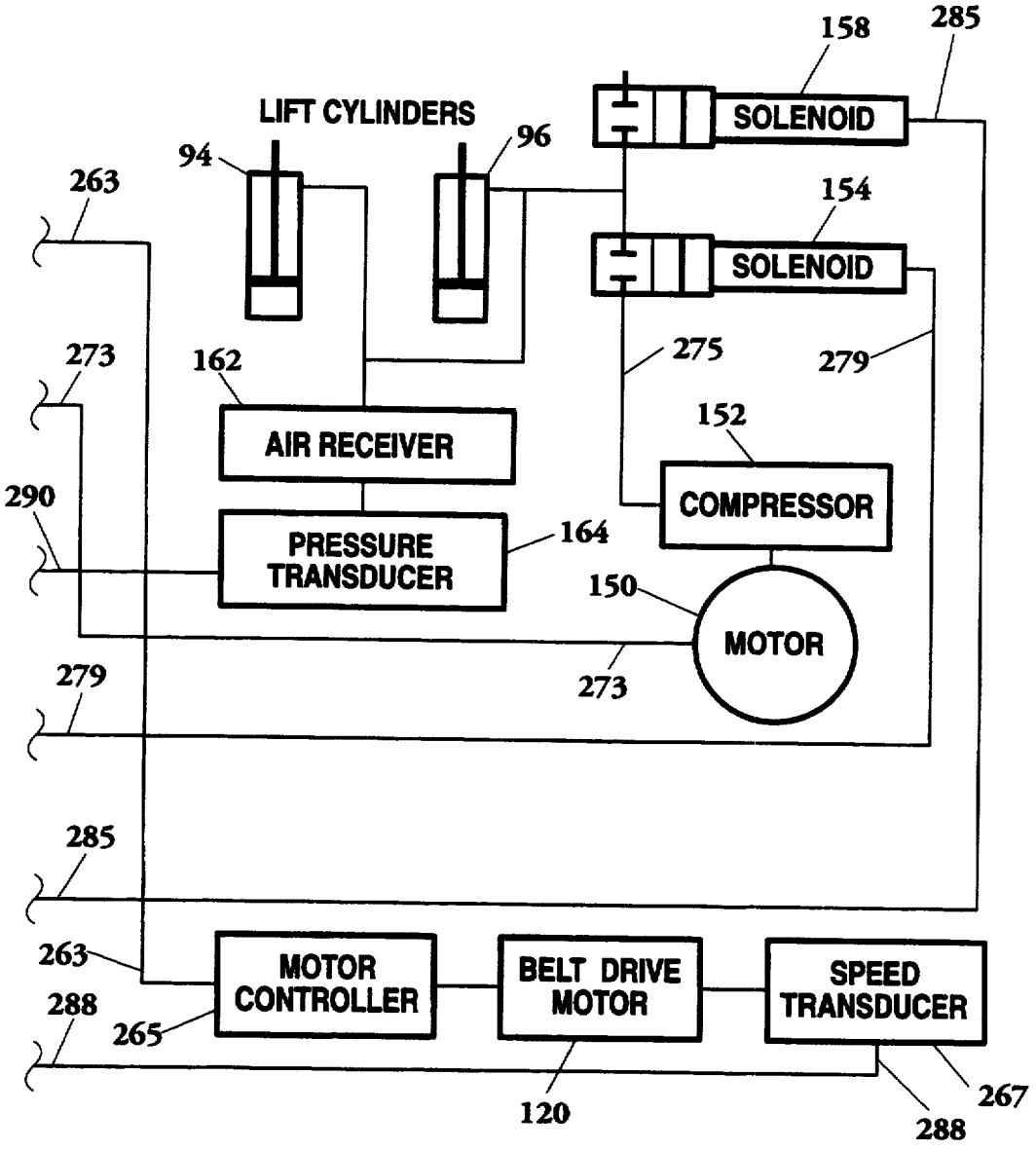
FIG. 4B is a continuation of the schematic view of FIG. 4A.

Referring now to FIGS. 4A and 4B, in operation the video monitor 104 displays a menu for selecting the various parameters listed above. After selection using the keyboard 108, the exerciser uses the machine and the computer 106 controls the variables.

FIGS. 4A and 4B, illustrate schematically how the computer system is connected to, and controls, the exercise device. Initially, after turning on the computer 106, the display screen of the video monitor 104 presents a menu from which the operator makes selections and inputs values and thus controls the operation of the device. The pathways involved in this will now be described in detail, with reference to FIGS. 4A and 4B. Control parameters representing the desired setting for each of: treadmill belt speed, suspension force, time periods are inputted into the computer by the operator. If the variables are to change after a period of time, information as to the length of this period and the value fo the next set of variables is supplied to the computer. Preferably, this input into the computer is done in conjunction with a selection menu generated on the video monitor screen.

Referring again to FIGS. 4A and 4B, power for the treadmill is controlled by the main power relay 259 and is connected to the computer 106 by line 261. Current from power relay 259 then travels by conduit 263 to the motor controller 265, which controls the treadmill belt drive motor 120 and runs it at the speed selected by the operator on the computer 106 (as described above). The speed is monitored by a speed transducer 267 which feeds a signal by line 288 back to the computer 106 which then compares the speed signal received from the transducer 267 with the desired speed that had been imputted into the computer. If there is a difference, the computer sends out a corrective signal, through conduit 286 to the motor controller 265 to either increase or decrease speed to conform to the desired input. It is well known for a computer to compare a signal of a variable signal with a required control parameter and to provide a correction signal for making adjustments to certain functions so that the signal of the variable causes physical changes so that the variable signal is the same as the control signal.

Air pressure source for the pneumatic linear actuators 94 and 96 is obtained by initiating a motor start signal in the computer 106 which is transmitted through conduit 271 to the relay 276 which connects an electrical power source via conduit 273 to motor 150 which then drives air compressor 152. A signal from pressure transducer 164 is transmitted to computer 106 via conduit 290.

The computer 106, from the input data, sends a signal along path 277 to the relay for the pressure valve 278 which then sends an electrical current via conduit 279 to the system pressurization solenoid valve 154 and the current, by its presence or absence, opens or closes the valve therein to control (either permit or stop) the flow of pressurized air from the air compressor 152 into the pneumatic linear actuators 94 and 96. The air receiver is connected fluidly to the pressure source for the pneumatic linear actuators 94 and 96. The transducer 164 sends a signal along path 290 to computer 106 to compare the actual and input control pressure values, and to adjust accordingly. In the event the pressure is too high, a signal from the computer 106 is transmitted on conduit 283 to the vent valve relay 280. This closes a power circuit so that electrical current is transmitted over conduit 285 to the vent solenoid valve 158 which, when energized, opens vent solenoid valve 158 allowing excess pressure to be vented. If the pressure as measured by the transducer 164 is too low, then the system pressurization solenoid valve 154 is activated to provide more pressure to the cylinders. This is accomplished by the computer 106 transmitting a control signal over conduit 277 to pressure valve relay 278. This closes the power circuit and energizes the system pressurization solenoid valve 154 to open it so that high pressure air may be supplied to the pneumatic linear actuator 94 and 96. Solenoid valves 154 and 158 are normally closed and open when energized.

One use for this invention is in the field of orthopedic therapy. Orthopedic therapists commonly prepare an "exercise prescription" when a patient is to be put through an exercise routine. This prescription can include any or all of the above variables. In a manual mode, the therapist must individually monitor the patient and change the settings on the machine; thus, in effect, a therapist to patient ratio of one to one is needed, which is an inefficient use of the therapist. In contrast, the use of a computer controlled system allows the therapist to present parameters, to monitor multiple machines, and to keep a record of performance data.

A typical exercise prescription that could be used is as follows:

Phase 1
- Belt speed = 1.5 MPH
- Time period = 3 min.
- Suspension assist = 40%

Phase 2
- Belt speed = 1.5 MPH
- Time period = 5 min.
- Suspension assist = 30%

Phase 3
- Belt speed = 2.0 MPH
- Time period = 2.5 min.
- Suspension assist = 25%

Phase 4
- Belt speed = 1.5 MPH
- Time period = 5 min.
- Suspension assist = 35%

While the invention has been described with a computer control system with automatic feedback control loops, it can be appreciated that a pressure gage and manually operated electrical switches could be employed to operate the solenoid valves and motors in lieu of the computer system and the system would still function in a like manner, albeit with less efficiency and accuracy.

Figure 5:
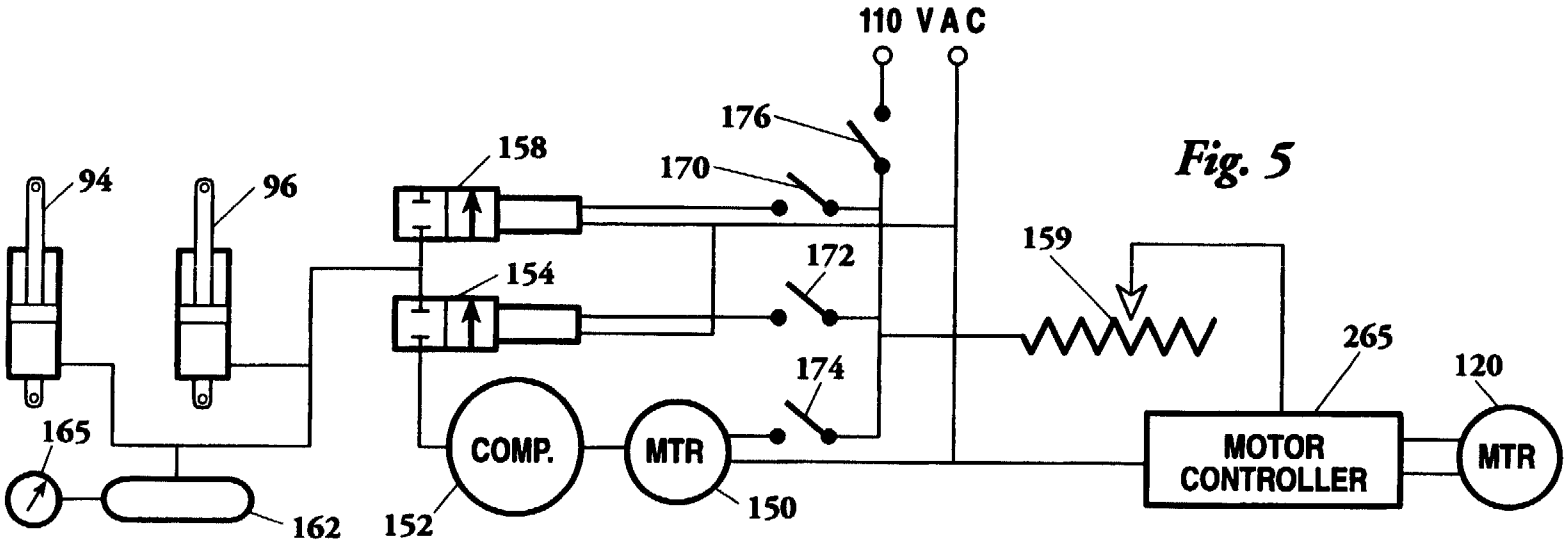
FIG. 5 is a schematic view of the pneumatic system and motor drive system of the device in a manual control version.

FIG. 5 illustrates in schematic form, a manual control system that is an alternative to computer control. This includes a potentiometer 159 for varying the input signal to the motor controller 265 which controls the speed of the treadmill drive motor 120. Main power electric switch 176 is provided to control power to all functions.

Still referring to FIG. 5, pressure gage 165, fluidly attached to air receiver 162, is provided to monitor the gas pressure in the pneumatic system which can be mathematically related to the uplift force exerted by the gantry frame. Electric switch 174 is provided to control power to motor 150 which drives air compressor 152. Electric switch 172 is provided to control power to system pressurization solenoid valve 154 and electric switch 170 is provided to control power to vent solenoid valve 158.

Again referring to FIG. 5, it can be appreciated that closing switch 172 will thus open solenoid valve 154 whilst closing switch 174 will operate motor 150 and air compressor 152 and thus introduce pressurized air to air receiver 162 and pneumatic linear actuators 94 and 96 and thus apply an uplift force to the gantry frame. It can also be appreciated that monitoring the pressure gage 165 during the pressurization operation will allow the operator to cease pressurizing when the desired system pressure is attained. It can be further appreciated that excess pressure can be relieved by closing switch 170 and thus opening solenoid valve 158 and venting air whilst monitoring pressure gage 165 until the desired system pressure is attained.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An exercising device to suspend a portion of a person's weight while walking comprising:

a base frame;

moveable treadmill belt supported by said base frame;

said means for selectively varying and imparting an upward force comprising the inclusion of pneumatic linear actuators and variable gas pressure supply means interconnected between said upwardly extended support member and said gantry frame for selectively varying and imparting an upward force to said gantry frame;

at least one upwardly extending support member affixed to said base frame;

a gantry frame pivotally connected to said upwardly extending support member;

means for selectively varying and imparting an upward force to said gantry frame;

means for suspending a person from said gantry frame.

2. An exercising device to suspend a portion of a person's weight while walking comprising:

base frame;

a moveable treadmill belt supported by said base frame;

at least one upwardly extending support member affixed to said base frame;

a gantry frame pivotally connected to said upwardly extending support member;

inclusion of pneumatic linear actuators and variable gas pressure supply means interconnected between said upwardly extended support member and said gantry frame for selectively varying and imparting an upward force to said gantry frame;

means for selectively varying the speed of said treadmill;

means for suspending a person from said gantry frame.

3. An exercising device as described in claim 2 in which means for controlling, changing and monitoring variables includes a computer.

4. An exercising device as described in claim 2 in which means for controlling, changing and monitoring variables includes a fluid pressure gage and manually operated electrical switches and potentiometers.

* * * * *